US005707450A

United States Patent [19]

Thompson

[11] Patent Number: 5,707,450

[45] Date of Patent: Jan. 13, 1998

[54] APPARATUS FOR HOLDING A VEHICLE BODY PART

[76] Inventor: Brad R. Thompson, 3-2275 West 39th Avenue, Vancouver, British Columbia, Canada, V6M 1T8

[21] Appl. No.: 643,956

[22] Filed: May 7, 1996

[51] Int. Cl.[6] ..... B05C 13/00

[52] U.S. Cl. ..... 118/500; 269/17; 269/71

[58] Field of Search ..... 118/500; 269/17, 269/71, 909; 248/125.1, 125.3, 125.7, 231.51, 299.1

[56] References Cited

U.S. PATENT DOCUMENTS

| | | | |
|---|---|---|---|
| 2,976,033 | 3/1961 | Martin | 269/17 |
| 4,029,308 | 6/1977 | Mathers | 269/17 |
| 4,838,199 | 6/1989 | Weber | 269/17 |
| 5,094,183 | 3/1992 | Hamasaki | 118/500 |
| 5,135,205 | 8/1992 | Bedard | 269/17 |
| 5,296,030 | 3/1994 | Young | 110/500 |

OTHER PUBLICATIONS

Brochure for Bump–Bench, Brut Manufacturing Company (12/95).

*Primary Examiner*—Laura Edwards
*Attorney, Agent, or Firm*—Oyen Wiggs Green & Mutala

[57] ABSTRACT

An apparatus for holding a vehicle body part for painting has a support attached to a pivotable arm on a stand. The height of the stand and the position of the pivotable arm is adjustable. The support includes three support arms which can be set in different positions to hold body parts of various shapes and sizes in a convenient position. Cords attached to the pivot arm are used to hold the body parts in position on the support arms.

9 Claims, 3 Drawing Sheets

APPARATUS FOR HOLDING A VEHICLE BODY PART

FIELD OF THE INVENTION

The invention pertains to an apparatus for holding a workpiece, and in particular to an apparatus for holding a vehicle body part, such as an automobile bumper or body panel, for repair and painting.

BACKGROUND OF THE INVENTION

Vehicle bodyparts that require spray painting or other surface treatment following body repair include bumpers, body panels and spoilers. It is often desirable to remove the damaged bodypart from the vehicle and repair and repaint it before reinstalling it on the vehicle. It is common practice to support such body parts during repair, surface preparation and repainting by placing them on a sawhorse-type stand. Vehicle body parts are made in various shapes and sizes. They typically have an outer surface that requires painting and an inner surface that does not. It is desirable to provide an apparatus which can hold a variety of such body parts in a convenient position for repair, surface preparation, painting and without interfering with the surface that is to be painted. The present invention provides such an apparatus.

SUMMARY OF THE INVENTION

In accordance with a preferred embodiment of the invention, there is provided an apparatus for holding a vehicle body part. The apparatus includes a stand and an arm pivotally attached to the stand for pivoting about a horizontal axis, the arm having a first part on one side of the point of attachment and a second part on the other side thereof. Stop means are provided for supporting the pivotable arm in a selected position. Support means are connected to the first part of the pivotable arm for supporting the vehicle body part. The apparatus preferably includes holding means connected to the second part of the pivotable arm for attaching to the body part to hold it against the support means.

The support means preferably comprises a horizontal tubular member having two ends, a horizontally-extendible extension member in each end thereof, means for fixing the extension members in a selected position within the tubular member, and a support arm extending from each of the tubular members. The support means preferably includes a third support arm spaced from the pivotal arm and generally parallel thereto, and means for adjusting the position of the third support arm.

BRIEF DESCRIPTION OF THE DRAWINGS

In drawings which illustrate a preferred embodiment of the invention

DETAILED DESCRIPTION OF THE PREFERRED EMBODIMENT

Figure 1:
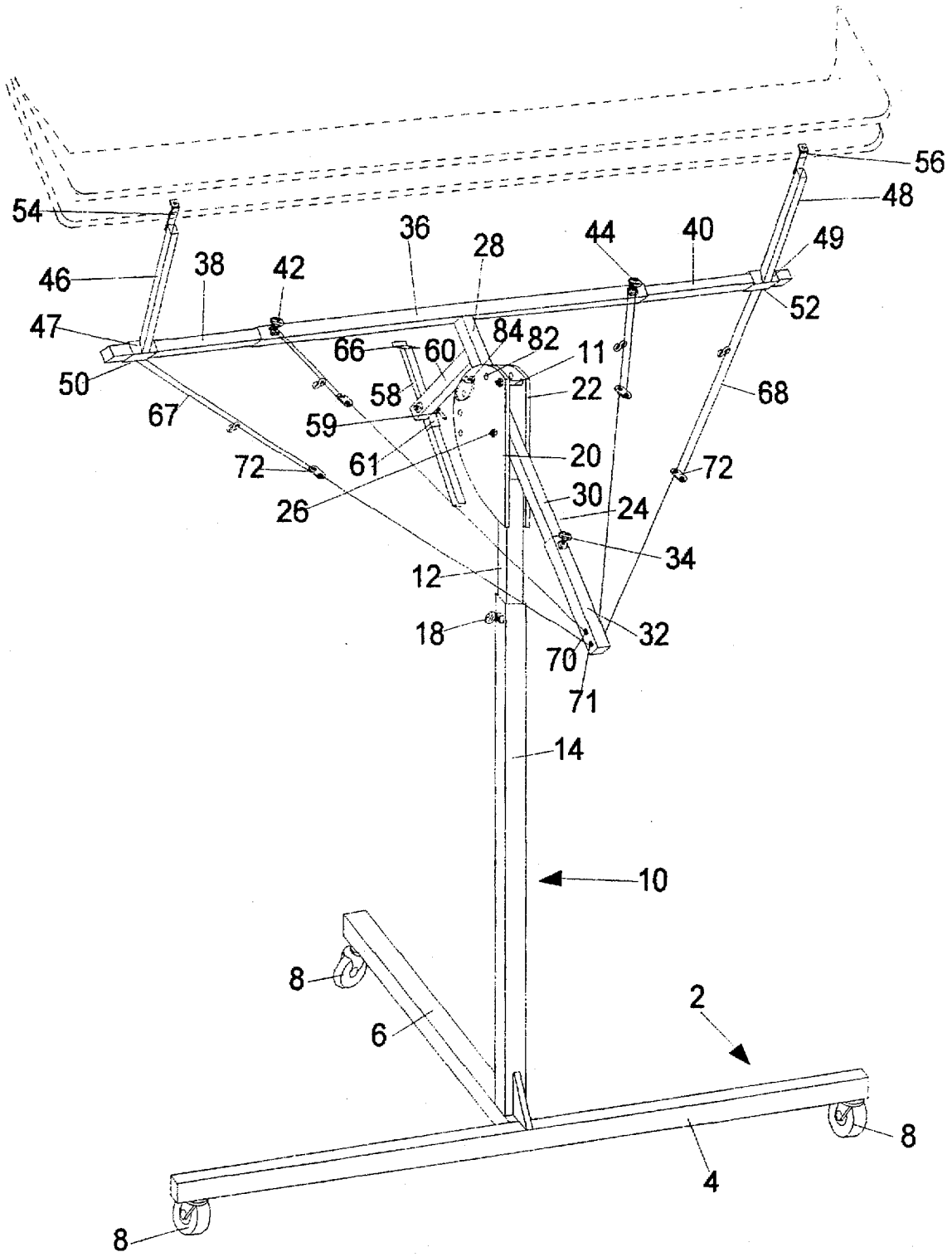
FIG. 1 is a perspective view of a preferred embodiment of the apparatus holding an automobile spoiler.

Referring to FIG. 1, the apparatus is constructed generally of rectangular tubular steel members. It has a base 2 comprising horizontal support bar 4 welded to horizontal support bar 6 forming a three-ended base. Casters 8 are affixed at the three ends of the base permitting the apparatus to be wheeled across a floor for use or storage. Standard 10 is welded to support bar 4 at its point of intersection with support bar 6 and extends upwardly therefrom. Standard 8 is a telescoping unit comprising an upper extension member 12 which fits slidably into sleeve 14. Extension member 12 is secured in a selected vertical position in sleeve 14 by bolt 18 which extends through a threaded bore in the upper end of sleeve 14 and is tightened against the side of extension member 12.

Two generally semi-circular steel plates, 20, 22 are welded in parallel spaced-apart orientation to the upper end of extension member 12 of standard 10. They are secured together at their upper end by bolt 11. Arm 24 is pivotally mounted on a pivot pin 26 extending horizontally between plates 20, 22 for pivotal movement therebetween. A first portion 28 of pivot arm 24 extends from one side of the pivot pin and outwardly of the curved edge of the plates 20, 22 above support bar 6 of the base. A second portion 30 of pivot arm 24 extends from the other side of the pivot pin and beyond the straight edge of the plates 20, 22. The second portion 30 of the pivot arm 24 has a telescoping sleeve 32. Bolt 34 extends through a threaded bore in sleeve 32 for tightening sleeve 32 at a selected position on arm 24.

The outer end of the first portion 28 of pivot arm 24 has arm 36 welded thereto and extending laterally therefrom. Extension members 38, 40 fit within the ends of arm 36 and can be fixed in a selected position in arm 36 by tightening bolts 42, 44 in threaded bores in arm 36 against the side of extension members 38, 40.

Support arms 46, 48 are affixed to the outer ends of extension members 38, 40. Each support arm 46, 48 has a sleeve 47, 49 respectively which fits slidably over the extension member. Sleeves 47, 49 are secured in position by means of a bolt 50, 52 respectively in a threaded bore in the sleeves. The bolts are tightened against the extension members 38, 40. The support arms 46, 48 include plates 54, 56 at the ends thereof. The plates, 54, 56 are generally rectangular and may be covered with rubber pads or the like. They have bolt holes therein to permit attachment thereto of certain vehicle body parts, such as spoilers.

A third support arm 58 is connected to the first portion 28 of pivot arm 24 by member 60 which extends perpendicular to pivot arm 24. Support arm 58 is generally parallel to pivot arm 24. Member 60 has a bore 61 proximate the free end thereof through which arm 58 can slidably move in a longitudinal direction. Arm 58 is fixed in a selected position in bore 61 by bolt 59 which extends through a threaded bore in the side of member 60 and is tightened against the side of arm 58. Plate 66 is affixed to the outer end of arm 58.

The apparatus includes flexible cords 67, 68 for securing a vehicle body part firmly against plates 54, 56 and 66. The cords 67, 68 extend through openings 70, 71 in sleeve 32 adjacent the free end thereof. Cords 67, 68 have toggle plates 72 thereon to form loops in the ends of the cords and permit them to be adjusted to a desired length. Each loop has a hook 80 thereon adapted to engage a vehicle body part. In FIG. 1, which illustrates the apparatus holding a spoiler (shown in dotted lines), cords 67, 68 are not required to secure the spoiler, which is simply bolted to plates 54, 56; cords 67, 68 are accordingly shown placed in a convenient storage position, attached to bolts 50, 42, 40 and 52.

Plates 20, 22 have four pairs of aligned holes 82 vertically spaced adjacent the curved edge of the plates. Pin 84 is adapted to extend through one of said holes 82 in plate 20 and an aligned hole in plate 22. To set pivot arm 24 at a desired position, the first portion 28 of pivot arm 24 is held above a selected pair of holes 82, pin 84 is inserted through the holes and the first portion 28 of the pivot arm 24 is lowered to rest on the pin 84.

In use, the positions of the support plates 54, 56 and 66 are adjusted to the desired positions to support the particular vehicle body part to be repaired and painted, for example a bumper. Pin 84 is placed through a selected pair of holes 82, extension member 12 is set at a selected height in sleeve 14, sleeve 32 is set at a selected position on arm 24, the positions of extension members 38, 40 are set in arm 36, and the position of arm 58 is set in bore 61. The bumper is placed on the support plates 54, 56 and 66 with the plates touching only the inner surface of the bumper, which is not to be painted, and is held in position by securing hooks 80 at suitable attachment points on the inner surface of the bumper, and tightening cords 67, 68 by means of toggle plates 72. The bumper is then repaired and painted and is left on the apparatus until it is dry. The apparatus with the bumper on it can be wheeled to a drying area remote from the spray painting area if desired.

Figure 2:
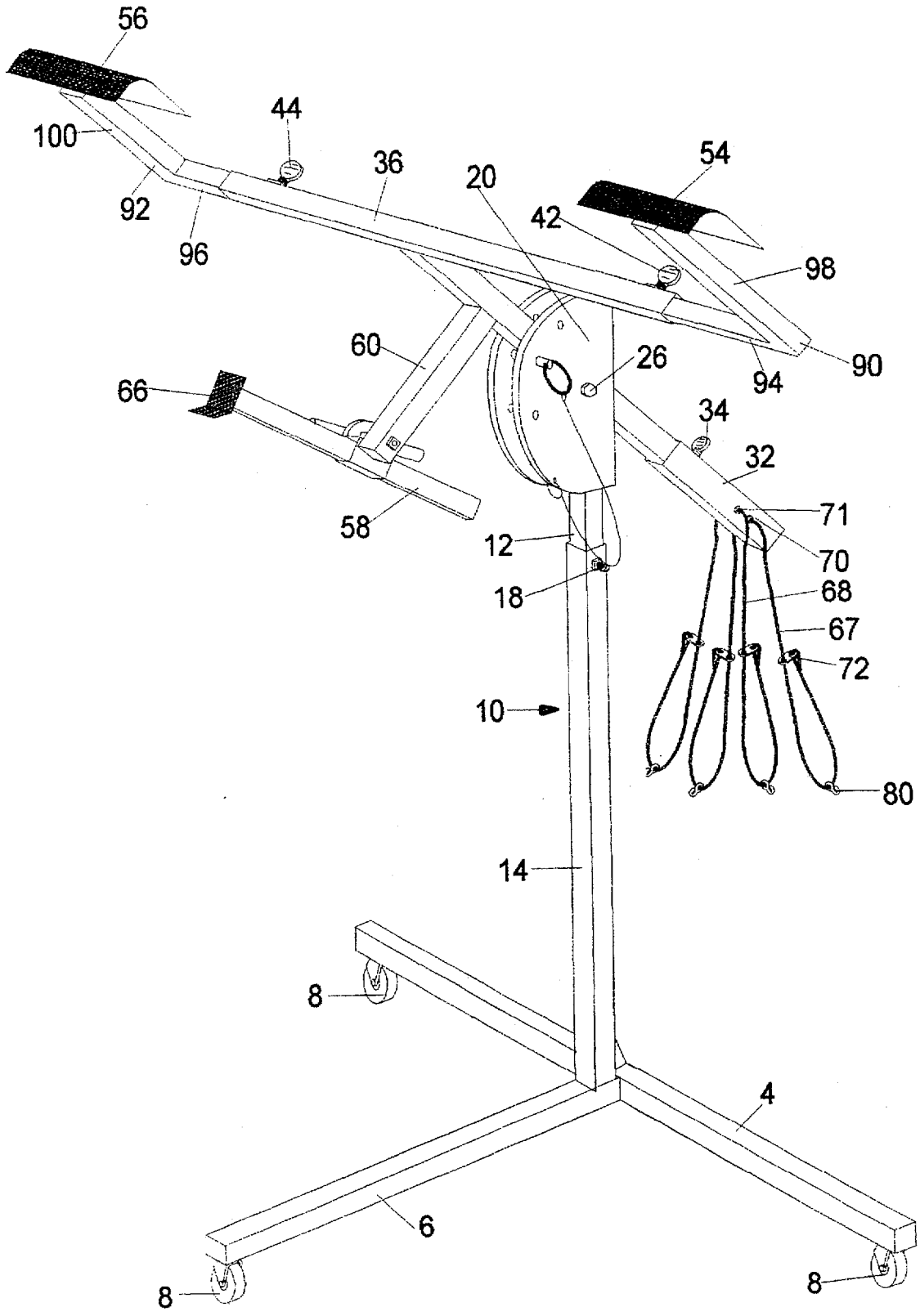
FIG. 2 is a perspective view of an embodiment of the apparatus having a modified support means.
Figure 3:
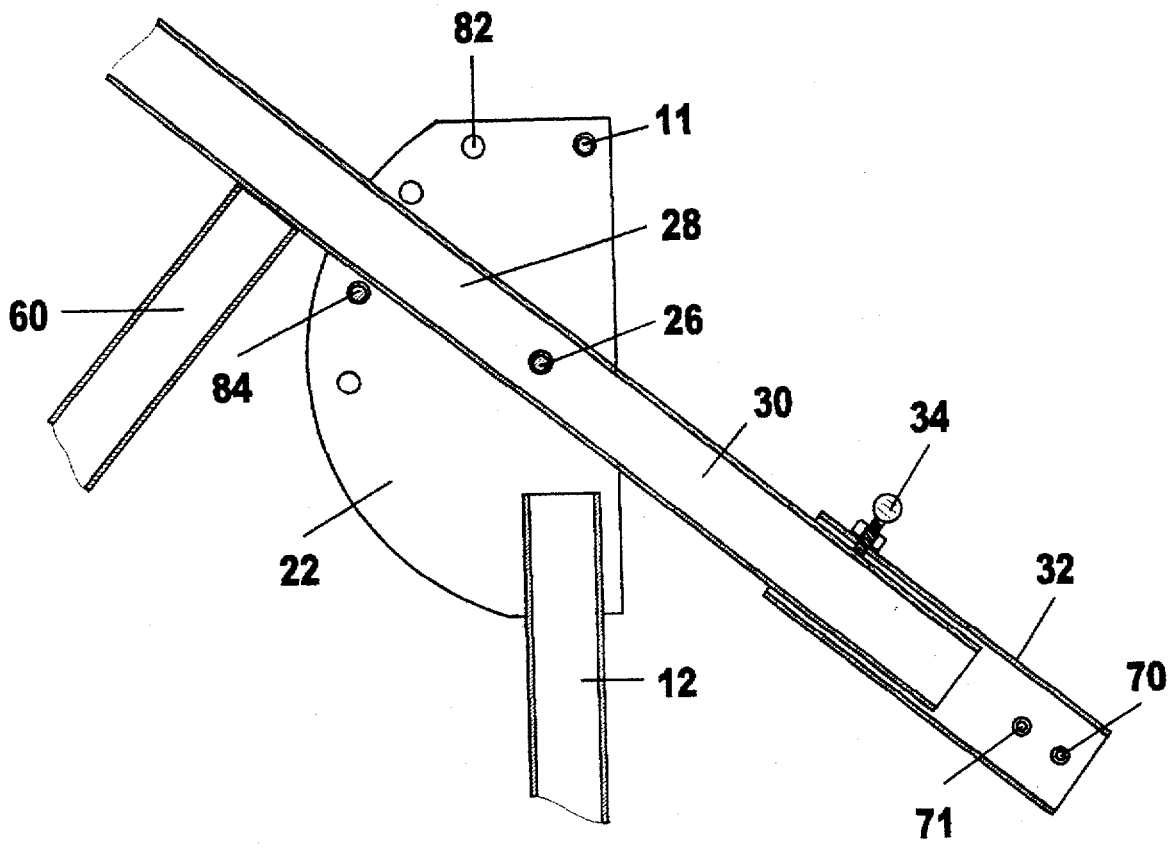
FIG. 3 is partial view in cross-section of the pivoting arm mechanism of the embodiments of FIGS. 1 and 2.

FIG. 2 illustrates an embodiment that is the same as the embodiment of FIG. 1 except for a modified support arm structure. In lieu of extension members 38, 40 and support arms 46, 48 of the embodiment of FIG. 1, there is provided L-shaped support arms 90, 92. Each support arm 90, 92 has a section 94, 96 respectively which slidably fits within arm 36 and is held in place therein at a selected position by tightening bolts 42, 44 against them. Sections 98, 100 extend at right angles from sections 94, 96 respectively and hold plates 54, 56 respectively at the ends thereof.

As will be apparent to those skilled in the art in the light of the foregoing disclosure, many alternations and modifications are possible in the practice of this invention without departing from the spirit or scope thereof. For example, the base may be configured in other ways, such as a horizontal rectangular plate with wheels at its corners; the standard and arms may be made of a fixed length rather than be telescoping; and the cords may be various tension producing means such as bungee cords. Accordingly, the scope of the invention is to be construed in accordance with the substance defined by the following claims.

What is claimed is:

1. An apparatus for holding a vehicle body part comprising:

a) a stand comprising a base and an upright member;

b) an arm pivotally attached to said stand for pivoting about a horizontal axis, said arm having a first part on one side of said axis and a second part on the other side thereof;

c) stop means attached to said upright member for supporting said pivotal arm in a selected position;

d) support means connected to said first part of said pivotable arm for supporting said body part, said support means comprising a horizontally-extending tubular member having two ends, a horizontally-extendible extension member in each end thereof, means for fixing said extension members in a selected position within said tubular member, and a support arm extending from each of said extension members; and e) holding means for attaching to said body part to hold said body part against said support means.

2. An apparatus for holding a vehicle body part comprising:

a) a stand comprising a base and an upright member;

b) an arm pivotally attached to said stand for pivoting about a horizontal axis, said arm having a first part on one side of said axis and a second part on the other side thereof;

c) stop means attached to said upright member for supporting said pivotal arm in a selected position;

d) support means connected to said first part of said pivotable arm for supporting said body part, said support means comprising a horizontally-extending tubular member having two ends, a support arm in each end thereof and means for fixing said support arms in a selected position within said tubular member; and e) holding means for attaching to said body part to hold said body part against said support means.

3. An apparatus according to claim 1 or 2 further comprising holding means connected to said second part of said pivotable arm.

4. An apparatus according to claim 3 further comprising means for varying the length of said second part of said pivotable arm.

5. An apparatus according to claim 2 wherein said support arms are generally L-shaped.

6. An apparatus according to claim 1 or 2 wherein said support means further comprises a third support arm spaced from said pivotable arm and generally parallel thereto.

7. An apparatus according to claim 1 or 2 wherein said stop means comprises a pair of spaced apart parallel plates, said horizontal axis being affixed therebetween.

8. An apparatus according to claim 7 wherein said stop means further comprises a plurality of paired holes in said plates and a member for inserting through a selected pair of holes for supporting said pivotable arm.

9. An apparatus according to claim 1 or 2 wherein said holding means comprises a plurality of elongate flexible tension members and body part engaging hook means carried by said tension members.

* * * * *